US006347413B1

(12) United States Patent
Sciscente et al.

(10) Patent No.: US 6,347,413 B1
(45) Date of Patent: Feb. 19, 2002

(54) HIP PADS

(75) Inventors: Daniel C. Sciscente, 8 Pitkin La., Congers, NY (US) 10920; John R. Hosking, 349 Reservoir Rd., Goshen, NY (US) 10924

(73) Assignees: Daniel C. Sciscente, Congers; John R. Hosking, Goshen; Gerard Varlotta; Todd Schlifstein, both of New York City, all of NY (US); part interest to each ( * ) Notice: Subject to any disclaimer, the term of this patent is extended or adjusted under 35 U.S.C. 154(b) by 0 days.

(21) Appl. No.: 09/836,673

(22) Filed: Apr. 16, 2001

(51) Int. Cl.[7] ..... A41D 13/00
(52) U.S. Cl. ..... 2/465; 2/23
(58) Field of Search ..... 2/455, 465, 227, 2/267–268, 463–467, 2.5, 16, 23, 44–45, 161.1, 164; 128/96.1–100.1; 602/5, 19; 428/191–192

(56) References Cited

U.S. PATENT DOCUMENTS 5,071,698 A * 12/1991 Scheerder et al. ..... 428/256
5,636,377 A * 6/1997 Wiener ..... 2/465
5,689,836 A * 11/1997 Fee et al. ..... 2/465
5,717,997 A * 2/1998 Garcia ..... 2/23
5,840,397 A * 11/1998 Landi et al. ..... 428/73
5,984,886 A * 11/1999 Miller ..... 602/19

* cited by examiner

*Primary Examiner*—Gloria M. Hale
*Assistant Examiner*—Tejash Patel
(74) *Attorney, Agent, or Firm*—Stanley J. Yavner

(57) ABSTRACT

This invention provides a pair of pads for covering the area of the femur nearest the hip joint to distribute trauma forces to surrounding soft tissue areas, thereby protecting the bones proximate the hip joint from direct insult from injury when a person falls. The pads thereby spare the weak and osteoporatic bone from fractures. Each pad includes an inner core of linear density polyethylene molded to a shape to fit the proximal femur. The inner core of polyethylene or other suitable plastic covers an inner foam layer, with the inner core and inner foam layer being sandwiched between a secondary inner polyethylene foam layer and a primary outer layer of polyethylene foam laminated together at their edges.

5 Claims, 3 Drawing Sheets

FIG. 1
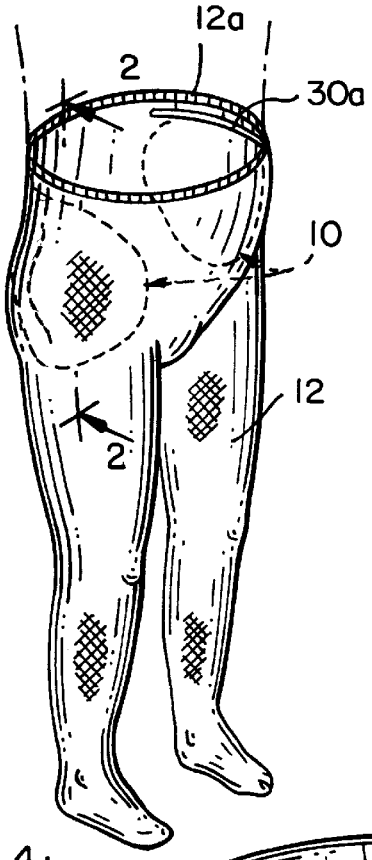
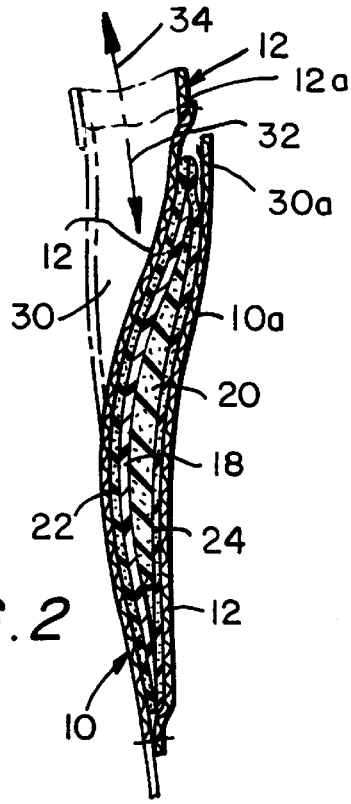
FIG. 2
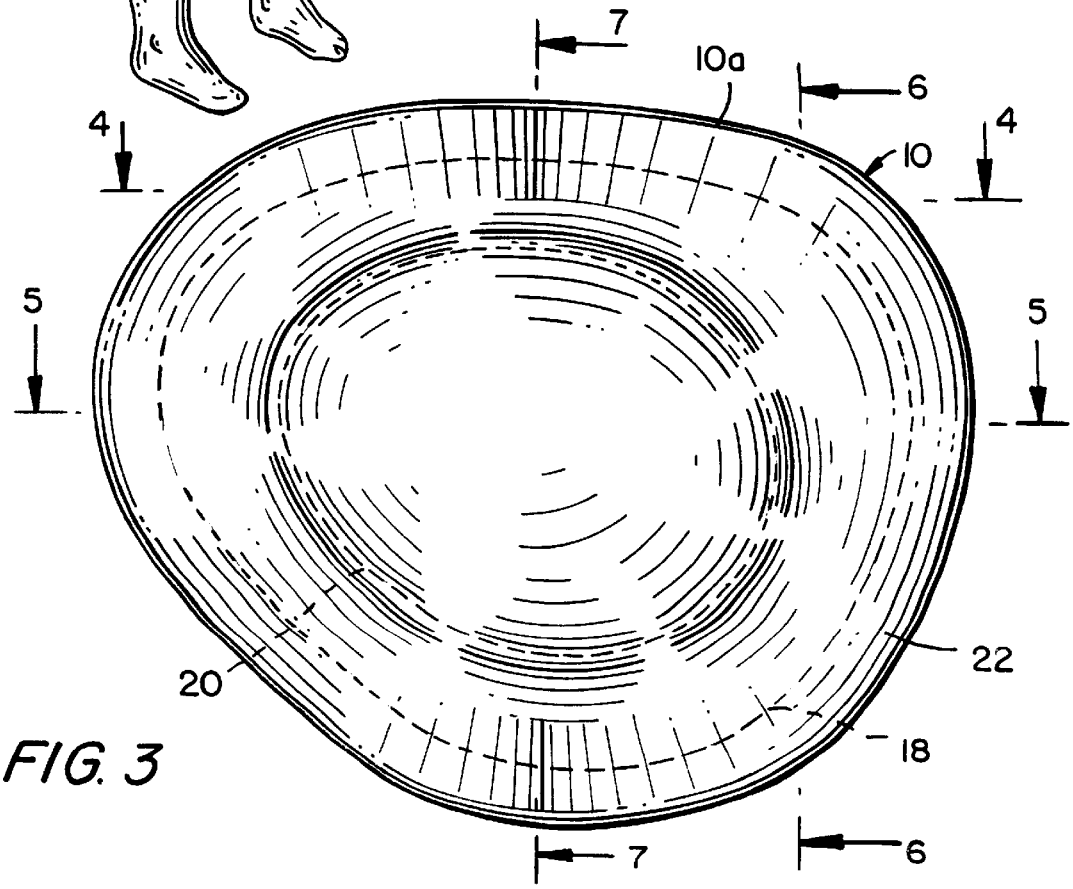
FIG. 3

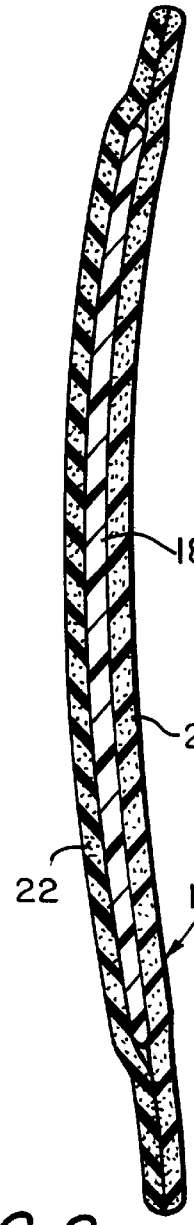
FIG. 6
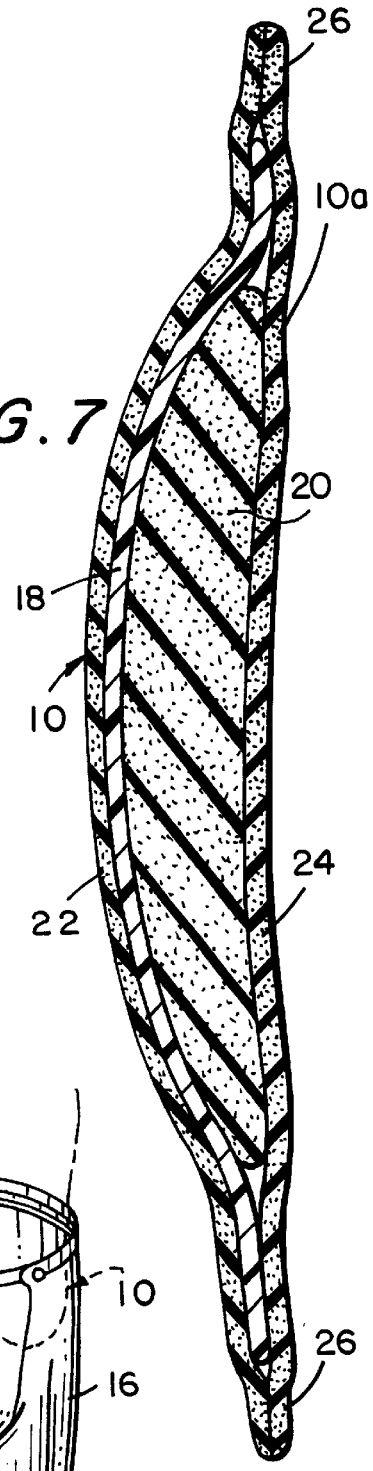
FIG. 7
FIG. 8
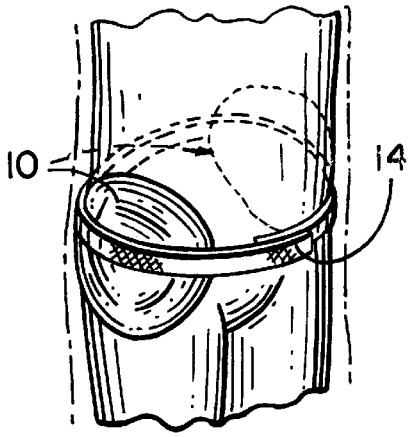
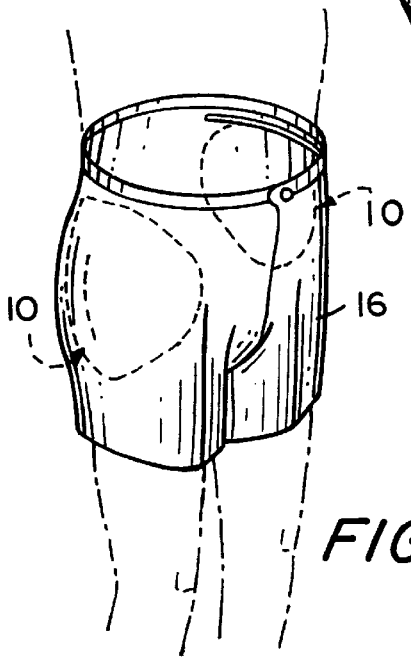
FIG. 9

HIP PADS

FIELD OF THE INVENTION

This invention relates primarily to human body pads and more particularly pads for the hip area which distribute forces encountered during a fall to surrounding soft tissue rather than merely cushion the hip areas from such force.

BACKGROUND OF THE INVENTION

Present-day hip pads and pads for other parts of the body primarily act as cushions to lessen the impact encountered during the user's fall, as an example. Of course, such pads also are presently used to provide the same type of cushioning effect, for instance, during sporting activity; e.g. a football player's helmut, a hockey goalee's knee pad etc. In either case, and in any case, the cushioning of a blow or the impact from a fall would cause less serious injury if the forces from such blow or impact were distributed to soft tissue area, than if such forces are merely cushioned.

This is particularly important with respect to weakened bones or osteoporatic bones, both found commonly in older persons.

It is also important, with respect to pads for lessening injury from an impact, that such pads fit the body area to be protected in a manner that is convenient and comfortable for the user.

OBJECTS AND SUMMARY OF THE INVENTION

Accordingly, a primary object of the present invention is to provide a hip pad for protecting the proximal area of the femur.

A more particular object of the present invention is to provide a pad for the proximal area of the femur which distributes the force encountered during a fall to surrounding soft tissue and more distal areas of the femur.

A still further object of the present invention is to provide a hip pad which is convenient and comfortable to use in order to provide more protection for the weak and osteoporatic bone from insult, which can result in hip fractures.

These and other objects of the present invention are provided by a hip pad which features an inner core of linear density polyethylene or other plastic, molded to fit the proximal area of the femur for the particular patient, a primary inner foam layer covered by the inner core, and the inner core and primary inner foam layer being sandwiched between a secondary inner layer of foam and a primary outer layer foam, which are laminated together primarily at their edges. The inner core serves to dissipate force to surrounding soft tissue and the more distal areas of the femur, with the primary inner foam layer acting as a bubble cushion, the secondary inner layer and the primary outer layer foam acting as a seal for the device to create an air bubble.

BRIEF DESCRIPTION OF THE DRAWINGS

Other objects, features and advantages of this invention will become apparent by the following detailed description of the preferred, but nonetheless illustrative, embodiment with reference to the accompanying drawings, wherein:

FIG. 1 is an isometric view showing the hip pads according to the present invention, held in place in the area of the proximal femur or hip joint, in panty hose pockets, or alternatively holding the hip pads in place with sticky inner faces adhering to the skin of the user to thereby distribute trauma forces to soft tissue areas surrounding the hip joint, and distributing such forces to the distal areas of the femur bones;

FIG. 2 is a partial front sectional view taken along the line 2—2 of FIG. 1, through the user's right hip pad, in a panty hose pocket;

FIG. 3 shows a hip pad, as it would be viewed from the outside of the user's right hip, without showing the user or the user's panty hose, in order to show the contour and the shape of the outside face of a hip pad according to the present invention;

FIG. 6 is a front sectional view taken along the line 6—6 of FIG. 3;

FIG. 7 is a front sectional view taken along the line 7—7 of FIG. 3;

FIG. 8 is a view similar to that of FIG. 1, but showing the hip pads secured by an elastic strap onto the hip areas of the user; and FIG. 9 is a view similar to that of FIG. 8, but showing the hip pads secured in place in inside pockets of a pair of shorts.

DETAILED DESCRIPTION OF THE PREFERRED EMBODIMENT

Figure 4:
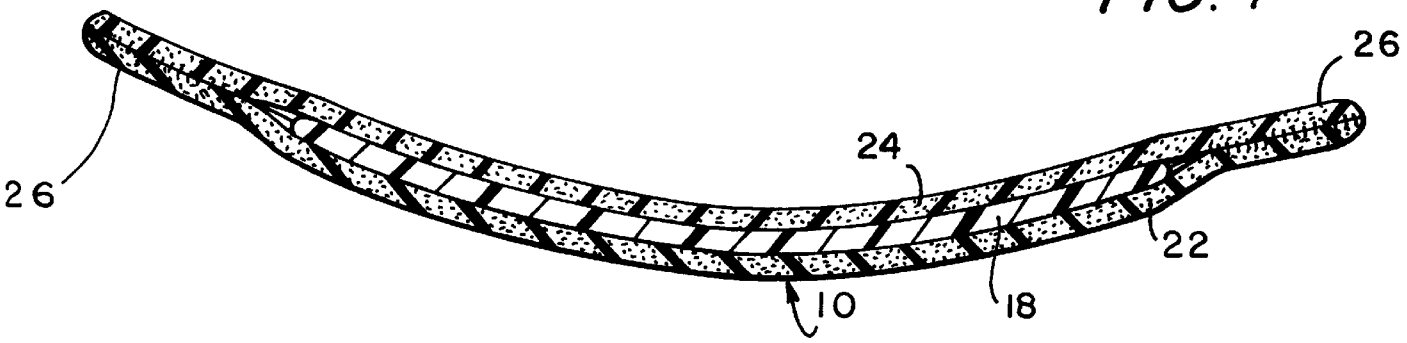
FIG. 4 is a top sectional view taken along the line 4—4 of FIG. 3.

As shown in FIGS. 1, 8 and 9, the hip pads generally designated 10 of the present invention are secured for use by a person to mostly prevent the usual broken bone effects, in the hip areas, of a trauma, by various different devices. As shown in FIG. 1, the hip pads 10 are either secured in place in inner pockets of a pair of panty hose 12; or, are secured in place by having on their inner face 10*a* an adhesive material for binding inner face 10*a* securely to the body of the user, such as by use of an adhesive as is commonly found in an adhesive bandage. Furthermore, FIG. 8 shows the hip pads 10 of the present invention as secured by an elastic belt 14; and in FIG. 9, as secured by being placed in the inner pockets of a pair of shorts 16.

As is shown particularly in FIG. 7, each hip pad 10, according to the present invention is formed of four basic pieces; namely, relatively stiff inner core 18 of linear density polyethylene, molded according to a plaster or like mold of the proximal femur of the intended user. Inner core 18 is bonded to a primary inner foam layer 20 near the center of the hip pad. Core 18 and inner foam layer 20 are then sandwiched between a primary outer layer of polyethylene foam 22 and a secondary inner layer of polyethylene foam 24. The secondary inner and primary outer foam layers 24, 22 are sealed at their edges 26 in order to seal the device to create an air bladder.

Accordingly, when secondary inner layer 24 is next to or proximate the skin of the user, the entire hip pad 10 distributes, rather than merely cushions any forces of a trauma impact, with the primary inner foam layer 20 acting as a bubble cushion and the entire device creating an air bladder effect.

Figure 5:
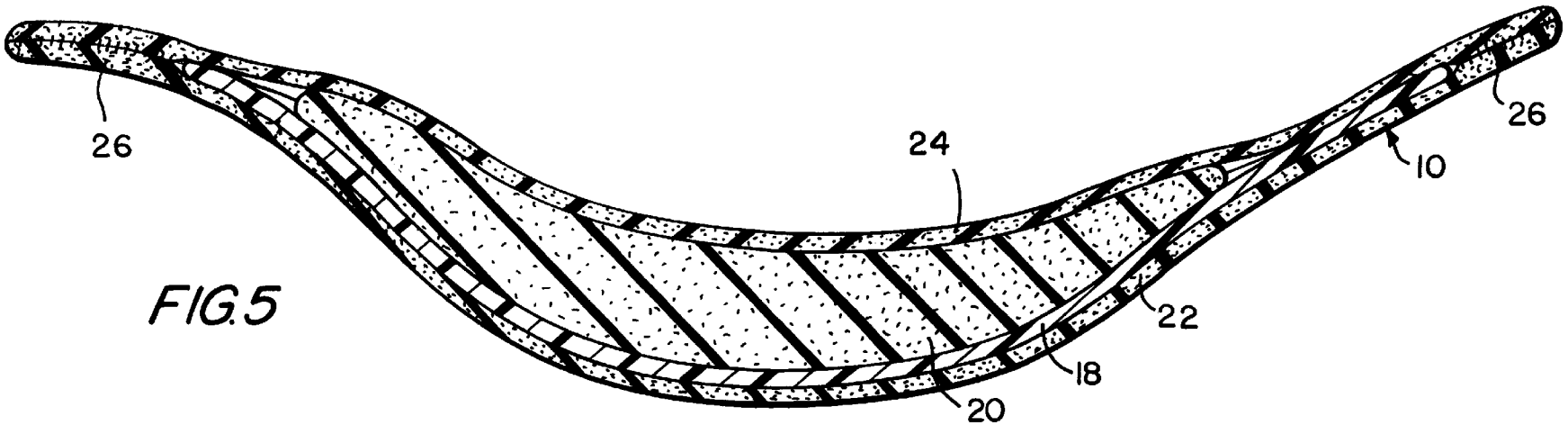
FIG. 5 is a top sectional view taken along the line 5—5 of FIG. 3.

FIGS. 4 and 5 particularly illustrate the sealing of the "sandwich" in the edge areas 26 of hip pad 10, with the "sandwich" being formed by primary outer layer of foam 22 and secondary inner layer of foam 24, encompassing primary inner layer of foam 20 and relatively stiff inner core 18 (FIG. 5). Of course, as is shown in FIG. 4, which is a section taken near the sealed edges 26 of hip pad 10, the relatively stiff core 18 is inside the "sandwich" formed by layers 22, 24; but the primary inner foam layer 20 does not extend beyond the central portion of the hip pad.

The first step in formation of a hip pad according to the present invention is to take a plaster casting from the area of the patient-user proximate the area of the upper or proximal femur near the hip joint. The plaster cast so obtained is then used to form a negative casting of plaster and then a material such as linear density polyethylene molded thereby in a thickness of approximately ⅛th to ¼ inch with beveled or rounded edges. The thickness is not critical, but should be of a thickness to allow stiff resilience, which of course can be provided by a variety of plastic materials. A generally round piece of foam 20 is then sealed to the concave or cupped section of core 18, but primary inner layer of foam 20 does not extend beyond the edges of the relatively stiff core 18. After sealing of core 18 to foam layer 20, they are then sandwiched between secondary inner foam layer 24 and primary outer layer of foam 22 (both of which are more durable than foam 20), which are sealed at their edges, and with foam 22 sealed overall to core 18, to form the hip pad and to keep core 18 and primary inner layer 20 in place. This construction serves to create an air bladder, with the primary inner foam layer 20 acting as a bubble cushion, to distribute trauma forces impacting the primary outer layer 22 to remote parts of the femur, and more importantly, to soft human tissue proximate the hip joint.

In order to provide a more complete description of the present invention, a series of use steps is now provided. Hip pad 10 is inserted by the user into pocket 30 formed by panty hose 12, and at the inside thereof, in the direction of arrow 32 (FIG. 2). Of course, the hip pad 10 may be taken out from pocket 30 in the direction of arrow 34 in FIG. 2. Usually, the insertion is performed by pulling panty hose 12 away from the body of the user (as shown by ghost lines in FIG. 2), and inserting hip pad 10, at an orientation concave against the body of the user and the inside of the panty hose, through pocket slit 30*a* at the inside of panty hose 12. Use of the hip pads are also enabled by the devices shown in FIGS. 8 and 9, in terms of elastic belt 14 and inner pockets of a pair of shorts 16.

The foregoing provides a complete and illustrative description of a structure to satisfy the objectives of the present invention; but the limits of this invention are to be provided only by the following claims:

What is claimed is:

1. A hip pad for protecting against the usual broken bone effects of a trauma at or near the proximal femur of the user, comprising a generally planar core of stiffly resilient plastic material formed by molding from the shape of the outside of the user's body near the proximal femur, a relatively soft primary inner foam layer bonded to said core, a primary outer foam layer bonded to said core and of a size extending generally in the plane of said core, but beyond the extent thereof to form a primary outer foam layer edge, and a secondary inner foam layer approximately coextensive with said primary outer foam layer and forming a secondary inner foam layer edge, said primary outer foam layer edge and said secondary inner foam layer edge of the hip pad is bonded to form, with said core and said primary inner foam layer, an air bladder device.

2. The invention according to claim 1 wherein said secondary inner foam layer and said primary outer foam layer, both define an exposed surface, which is more durable than the foam layer of which the primary inner foam layer is composed.

3. The invention according to claim 1 wherein said core defines an edge which is beveled.

4. The invention according to claim 1 wherein said core defines an edge which is rounded.

5. The invention according to claim 1 wherein said hip pad air bladder device defines an overall shape, and is adapted and arranged, for securement to said user at or near the proximal femur of the user.

* * * * *